US007798825B1

(12) United States Patent
Pai

(10) Patent No.: US 7,798,825 B1
(45) Date of Patent: Sep. 21, 2010

(54) PLUG WITH CONNECTING DEVICE

(75) Inventor: Jason Pai, Shenkeng Township, Taipei County (TW)

(73) Assignee: Taiwan Line Tek Electronic Co., Ltd., Taipei County (TW)

( * ) Notice: Subject to any disclaimer, the term of this patent is extended or adjusted under 35 U.S.C. 154(b) by 66 days.

(21) Appl. No.: 12/409,611

(22) Filed: Mar. 24, 2009

(51) Int. Cl.
*H01R 13/44* (2006.01)

(52) U.S. Cl. ..... 439/131

(58) Field of Classification Search ..... 439/465, 439/455, 687, 108, 425, 131, 812
See application file for complete search history.

(56) References Cited

U.S. PATENT DOCUMENTS 5,628,641 A * 5/1997 Hahn ..... 439/131
6,171,129 B1 * 1/2001 Phillips ..... 439/346
6,241,538 B1 * 6/2001 Chen ..... 439/131

* cited by examiner

*Primary Examiner*—Edwin A. Leon
(74) *Attorney, Agent, or Firm*—Guice Patents PLLC

(57) ABSTRACT

The present invention relates to a plug with connecting device, includes a top housing, one end thereof is extended with a connecting device for being connected to a power adapter; a retaining seat; an electrode sheet base having a pivotal shaft; two copper contact rings; two electrode sheets; one bottom plastic housing engaged with the top housing; when the two electrode sheets are longitudinally rotated, the two electrode sheets are able to be pivotally moved at the outside of the bottom plastic housing and then positioned, an electrical conducting status is formed between the electrode sheets and the connecting device so as to transfer power to a power adapter.

20 Claims, 8 Drawing Sheets

PLUG WITH CONNECTING DEVICE

BACKGROUND OF THE INVENTION

1. Field of the Invention

The present invention relates to a connecting device, more particularly to a plug with connecting device, one end thereof is connected to an AC power source through electrode sheets and the other end thereof is coupled with a power adapter through the connecting device so as to supply converted DC power to an electronic device.

2. Description of Related Art

A conventional plug often only has two electrode sheets for being connected to a socket so AC power is gained through the socket. There is also a kind of plug whose electrode sheets are foldable, the electrode sheets are folded into the plug main body when not in use to prevent oxidation and danger caused by users' misuse, such as children.

As for the above mentioned plugs, before shipped out of factory, the plug has often been connected with a cable. And another end of the cable has a matching socket relative to the plug, for being connected to an electronic device, e.g. a computer, so AC power is able to be converted into DC power through a power supply device installed in the electronic device.

For a portable electronic device, e.g. a notebook computer or a digital camera, because of space limitation, a power adapter is often used to convert AC power to DC power for supplying to the portable electronic device. Thus the described combination of plug and socket is not able to be connected to the power adapter and additional cost is occurred due to purchase the power adapter.

SUMMARY OF THE INVENTION

One object of the present invention is to provide a plug with connecting device, one end thereof is connected to an AC power source through electrode sheets and the other end thereof is coupled with a power adapter through the connecting device, so converted DC power is obtained and is supplied to an electronic device.

Another object of the present invention is to provide a plug with connecting device, electrode sheets thereof are able to be folded in a bottom plastic housing of the plug and an electrical connection to AC power source is terminated.

For achieving the described objects, one solution provided by the present invention is to provide a plug with connecting device, includes: a top housing having a hollow main body, a connecting device is extended from one end of the hollow main body for being connected to a power adapter, and the connecting device has two ring-shaped slots; a retaining seat received in the hollow main body and has a first retaining slot; two copper contact rings, one end of each of the copper contact rings is in a gradually expanding shape and respectively installed in the ring-shaped slots of the connecting device, the other end thereof is extended with a contact sheet; an electrode sheet base having a pivotal shaft and one lateral side of the pivotal shaft is received in the first retaining slot and two ends of the pivotal shaft are respectively provided with a switch seat, the switch seat further has a seat hole, a positioning slot and a protruding block; two electrode sheets, respectively received in the seat holes, one end of each of the electrode sheets has a wire hole; a bottom plastic housing, engaged with the top housing, and has a bottom housing surface, the bottom housing surface has four sheet wings, a housing slot is defined by every two sheet wings and the bottom end of the housing slot is hollow, an end section thereof has a plane hole to allow the electrode sheets expose outside, a second retaining slot is provided between the two housing slots for fastening the other lateral side of the pivotal shaft; so when the two electrode sheets are longitudinally rotated, the two electrode sheets are able to be pivotally moved between the housing slots and positioned in the retaining seat; the other ends of the electrode sheets are in contact with the contact sheets, so an electrical conducting status is formed between the two ring-shaped slots and the two electrode sheets.

For achieving the described objects, another solution provided by the present invention is to provide a plug with connecting device, includes: a top housing having a hollow main body, a connecting device is extended from one end of the hollow main body for being connected to a power adapter, and the connecting device has two ring-shaped slots; a retaining seat received in the hollow main body and has a first retaining slot and a column slot; two copper contact rings, one end of each of the copper contact rings is in a gradually expanding shape and respectively installed in the ring-shaped slots of the connecting device, the other end thereof is extended with a contact sheet; an electrode column base having a pivotal shaft and one lateral side of the pivotal shaft is received in the first retaining slot and two ends of the pivotal shaft are respectively provided with a switch seat, the switch seat further has a seat hole; two electrode columns, respectively received in the seat holes, one end of each of the electrode columns has a sealing cover and the other end is provided with a contact section after passing through the hole seat and exposing outside the switch seat; and a bottom plastic housing, engaged with the top housing, and has a bottom housing surface, the bottom housing surface has four sheet wings, a housing slot is defined by every two sheet wings and the bottom end of the housing slot is hollow, an end section thereof has a plane hole to allow the electrode columns expose outside, a second retaining slot is provided between the two housing slots for fastening the other lateral side of the pivotal shaft; so when the two electrode columns are longitudinally rotated, the two electrode columns are able to be pivotally moved between the housing slots and positioned in the column slot; the electrode columns are in contact with the copper contact rings, so an electrical conducting status is formed between the two ring-shaped slots and the two electrode columns.

DETAILED DESCRIPTION OF THE PREFERRED EMBODIMENT

Figure 1A:
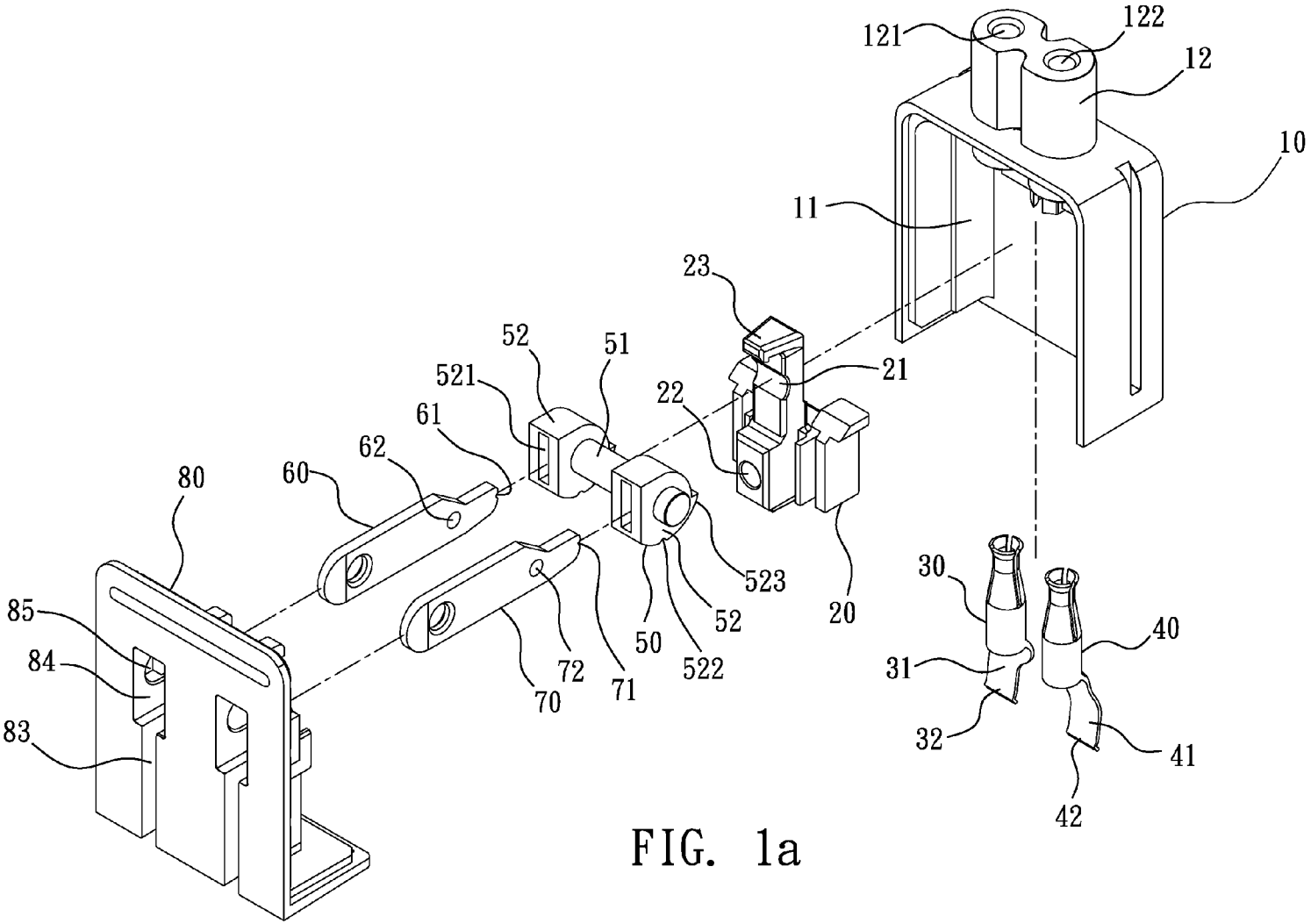
FIG. 1*a* is an exploded view of the plug with connecting device of one preferred embodiment of the present invention.
Figure 1B:
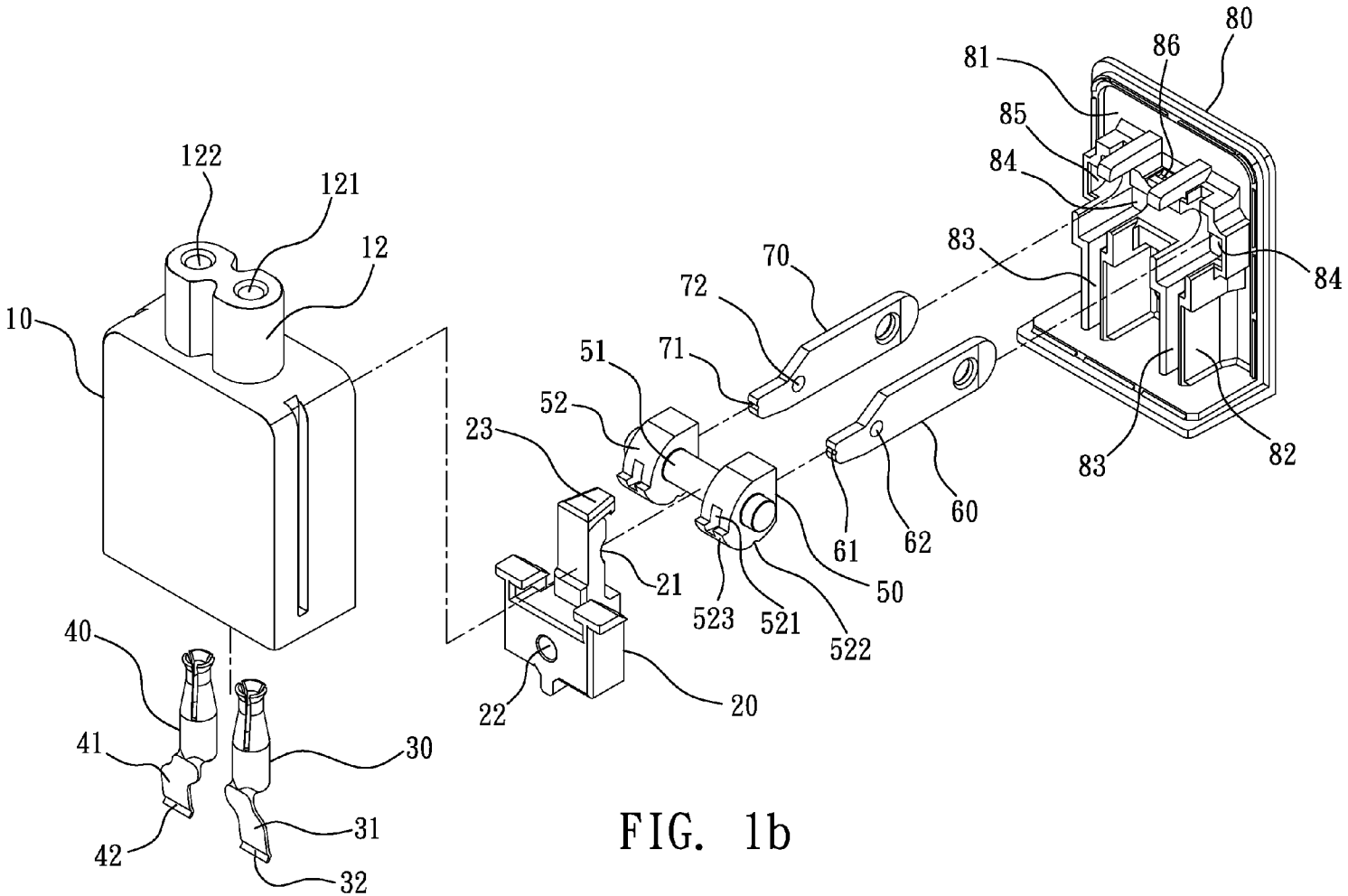
FIG. 1*b* is another exploded view of the plug with connecting device of one preferred embodiment of the present invention.
Figure 2B:
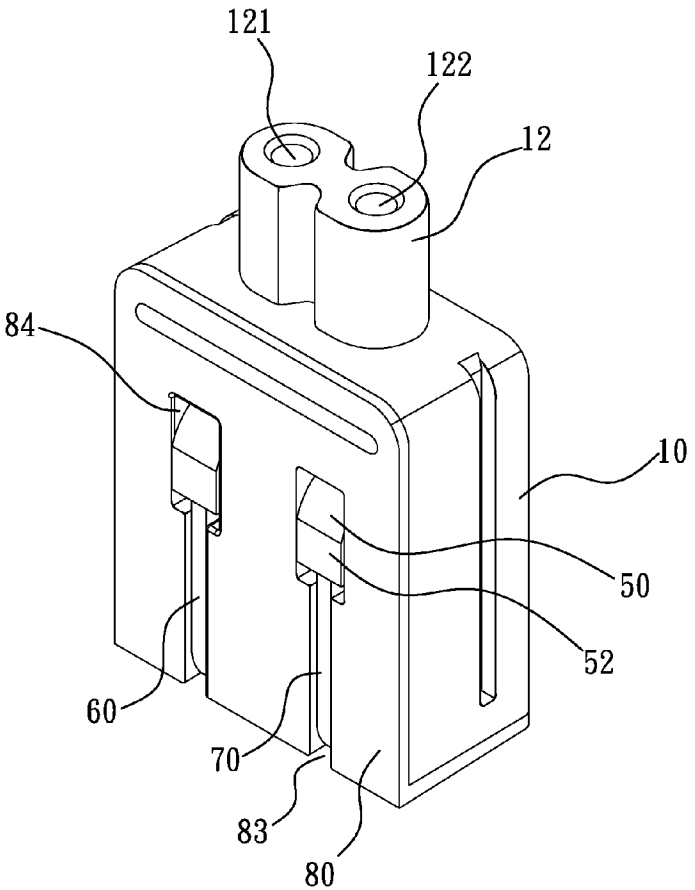
FIG. 2*b* is a schematic view of one preferred embodiment of the present invention illustrating after the plug with connecting device is assembled the electrode sheets thereof folding into the bottom plastic housing.
Figure 2A:
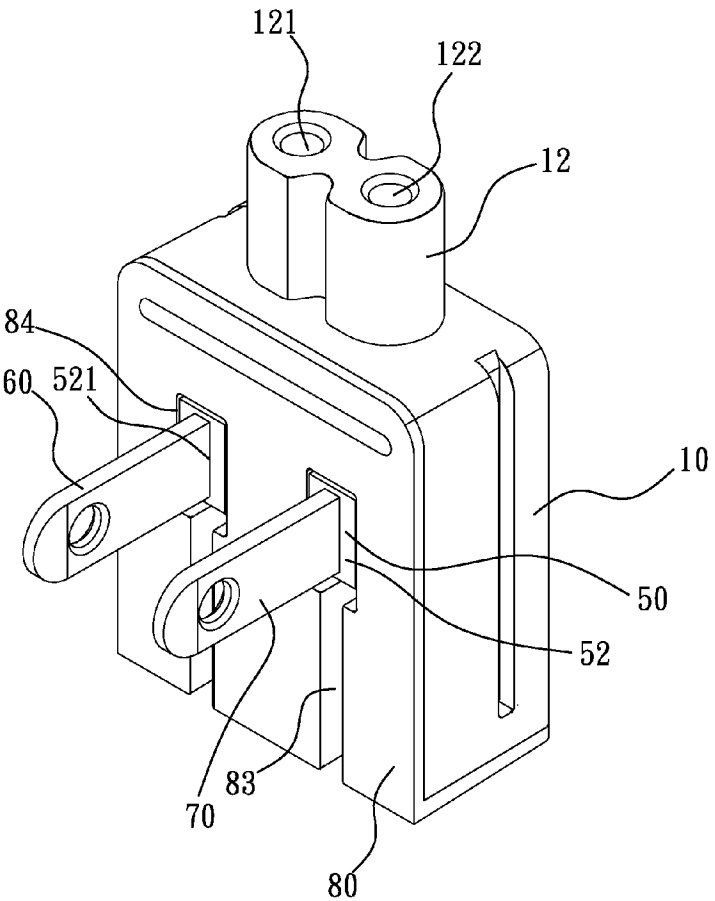
FIG. 2*a* is a schematic view of one preferred embodiment of the present invention illustrating after the plug with connecting device is assembled the electrode sheets thereof extending outside the bottom plastic housing.
Figure 3B:
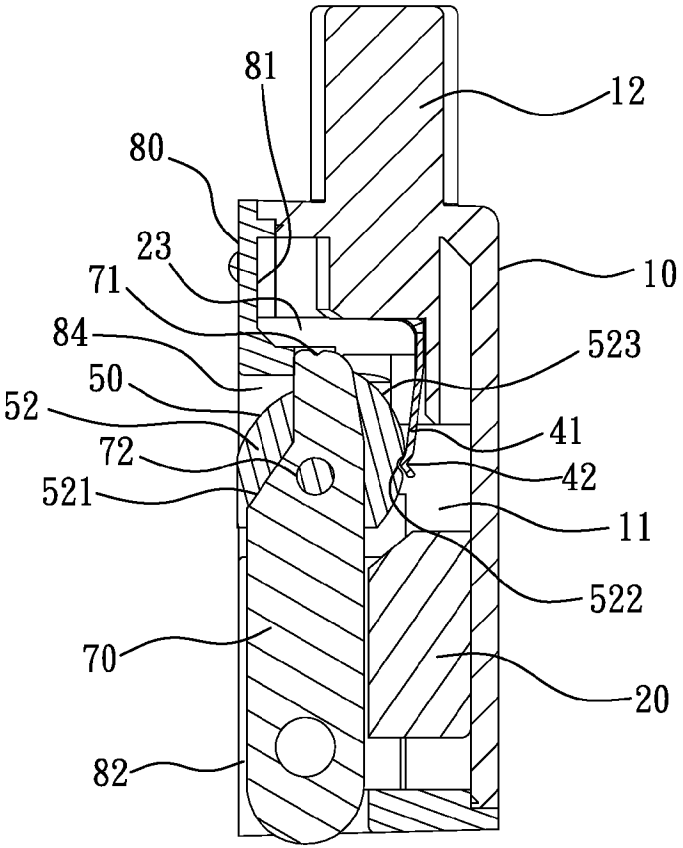
FIG. 3*b* is another schematic cross sectional view of the assembled plug with connecting device of one preferred embodiment of the present invention.

Referring to FIG. 1*a* to FIG. 3*b*, wherein FIG. 1*a* is an exploded view of the plug with connecting device of one preferred embodiment of the present invention; FIG. 1*b* is another exploded view of the plug with connecting device of one preferred embodiment of the present invention; FIG. 2*a* is a schematic view of one preferred embodiment of the present invention illustrating after the plug with connecting device is assembled the electrode sheets thereof extending outside the bottom plastic housing; FIG. 2*b* is a schematic view of one preferred embodiment of the present invention illustrating after the plug with connecting device is assembled the electrode sheets thereof folding into the bottom plastic housing; FIG. 3*a* is a schematic cross sectional view of the assembled plug with connecting device of one preferred embodiment of the present invention; FIG. 3*b* is another schematic cross sectional view of the assembled plug with connecting device of one preferred embodiment of the present invention.

As shown in figures, the plug with connecting device provided by the present invention, able to be used in a portable electronic device, e.g. a notebook computer, includes: a top housing 10, a retaining seat 20, two copper contact rings 30, 40, an electrode sheet base 50, two electrode sheets 60, 70, and a bottom plastic housing 80.

The top housing 10 has a hollow main body 11 and a connecting device 12 is extended from one end of the hollow main body 11 for being connected to a power adapter (not shown), and the connecting device 12 has two ring-shaped slots 121, 122, the connecting device 12 is, e.g. but not limited to, a socket with a shape like the numeral 8.

The retaining seat 20 is received in the hollow main body 11 and has a first retaining slot 21 with a semicircle shape; a bottom end of the retaining seat 20 is further provided with a retaining hole 22 and a top end thereof is provided with a buckling hook 23.

One end of each of the copper contact rings 30, 40 is in a gradually-expanding shape and is respectively received in the ring-shaped slots 121, 122 of the connecting device 12 and the other end thereof is respectively extended with a contact sheet 31, 41, and one end section of each of the contact sheet 31, 41 respectively has a sheet slot 32, 42.

The electrode sheet base 50 has a pivotal shaft 51 with a, e.g. but not limited to, round shape, one lateral side of the pivotal shaft 51 is received in the first retaining slot 21, and two ends of the pivotal shaft 51 respectively has a switch seat 52, the switch seat 52 further has a seat hole 521, a positioning slot 522 and a protruding block 523, wherein the seat holes 521 are served to respectively receive the electrode sheets 60, 70, the shape of the protruding block 523 is, e.g. but not limited to, an arc shape for being fastened on the retaining sheet 20.

The two electrode sheets 60, 70 are respectively received in the corresponding seat hole 521, one end of each of the electrode sheets 60, 70 has a sheet trench 61, 71, the other end thereof has a wire hole 62, 72; the sheet trenches 61, 71 are respectively received in the sheet slots 32, 42 for being in contact with the ring-shaped slots 121, 122.

The bottom plastic housing 80 is able to be engaged with the top housing 10, and has a bottom housing surface 81, the bottom housing surface 81 has four sheet wings 82, and a housing slot 83 is defined by every sheet wings 82, the bottom end of the housing slot 83 is hollow and an end section of the housing slot 83 has a plane hole 84 with a width larger than the width of the housing slot 83 to receive the switch seat 52 and to allow the electrode sheets 60, 70 expose outside, a second retaining slot 85 is provided between the two housing slots 83, the shape thereof is, e.g. but not limited to, in a semicircle shape for fastening the other lateral side of the pivotal shaft 51. The top housing 10 and the bottom plastic housing 80 are made of insulation materials, e.g. but not limited to plastic. The bottom plastic housing 80 further has a buckling slot 86 for being buckled with the buckling hook 23 so as to fasten the retaining seat 20.

Figure 3A:
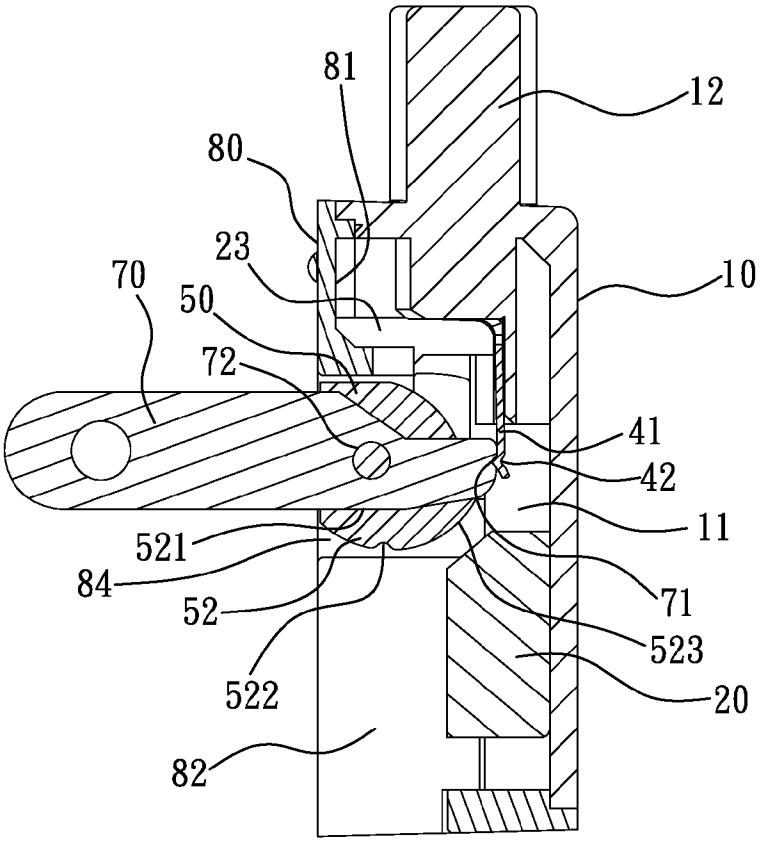
FIG. 3*a* is a schematic cross sectional view of the assembled plug with connecting device of one preferred embodiment of the present invention.

As shown in FIG. 2*a* and FIG. 3*a*, when assembled, the two copper contact rings 30, 40 are respectively installed in the two ring-shaped slots 121, 122, so the contact sheets 31, 41 expose outside the hollow main body 11; the pivotal shaft 51 of the electrode sheet base 50 is received in the first retaining slot 21 for positioning and fastening; then the two electrode sheets 60, 70 are respectively installed in the corresponding seat hole 521; the other lateral side of the pivotal shaft 51 of the electrode sheet base 50 is received in the second retaining slot 85 and the buckling hook 23 is buckled with the buckling slot 86 for positioning and fastening, so the two electrode sheets 60, 70 partially expose outside the housing slots 83; then the top housing 10 is engaged with the bottom plastic housing 80, so the sheet trenches 61, 71 are respectively received in the sheet slots 32, 42 for being in contact with the ring-shaped slots 121, 122 and the two electrode sheets 60, 70 are outwardly pushed so the protruding block 523 is fastened on the retaining seat 20 for positioning; the plug with connecting device provided by the present invention is therefore obtained. After the assembly of the plug with connecting device provided by the present invention is assembled, the connecting device 12 is connected to a power adapter (not shown), an AC power source is therefore transferred to the power adapter through the copper contact rings 30, 40.

As shown in FIG. 2*b* and FIG. 3*b*, when folded, the two electrode sheets 60, 70 are inwardly pushed into the bottom plastic housing 80 alongside the housing slot 83 and the plane hole 84, and the sheet trenches 61, 71 are released from the sheet slots 32, 42 and the two electrode sheets 60, 70 are aligned with the housing slots 83 to achieve a convenient storage purpose, thus the two electrode sheets 60, 70 are not in contact with the ring-shaped slots 121, 122 and a power supply terminating status is achieved.

Figure 4A:
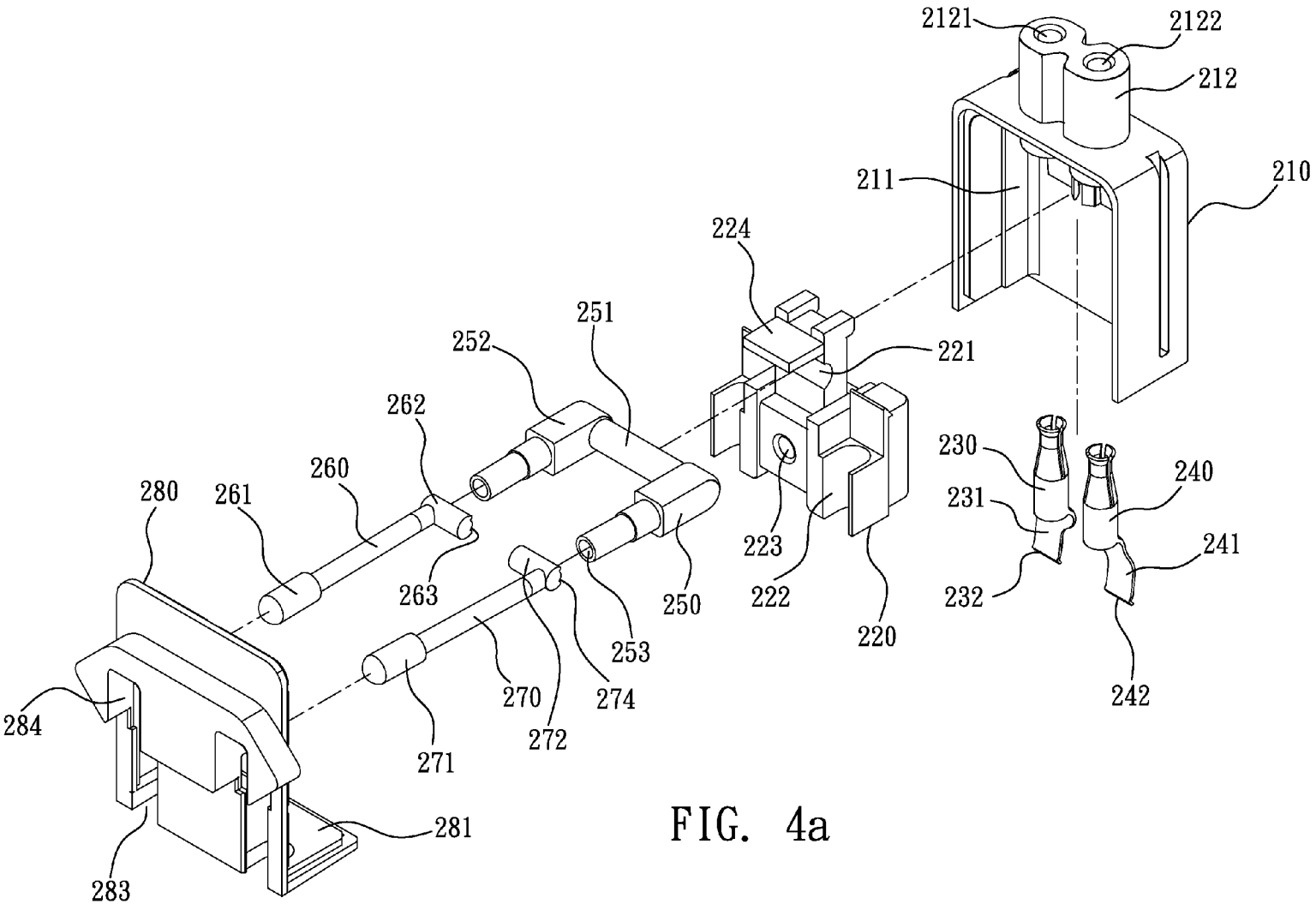
FIG. 4*a* is an exploded view of the plug with connecting device of another preferred embodiment of the present invention.
Figure 4B:
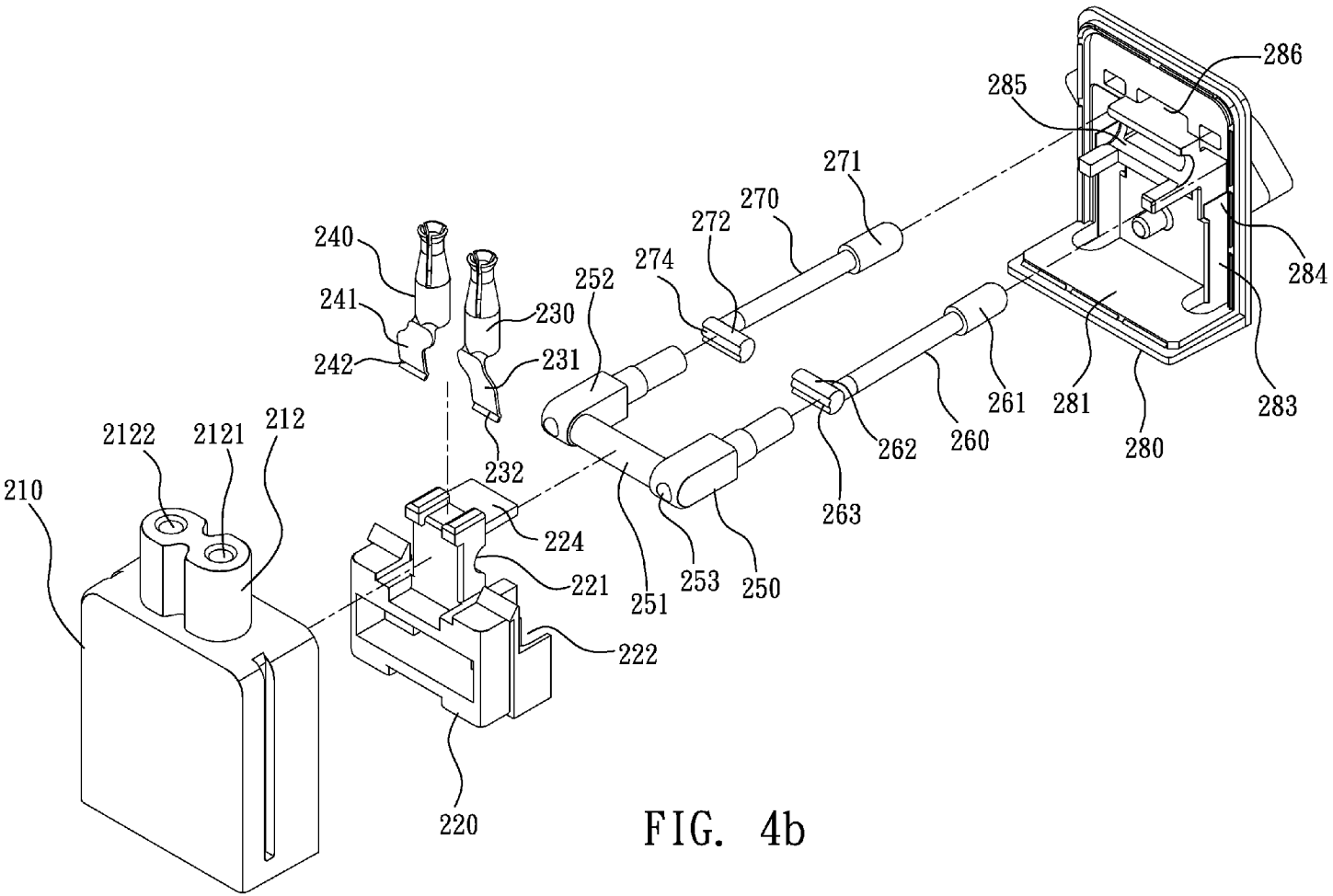
FIG. 4*b* is another exploded view of the plug with connecting device of another preferred embodiment of the present invention.

Referring to FIG. 4*a* to FIG. 6*b*, wherein FIG. 4*a* is an exploded view of the plug with connecting device of another preferred embodiment of the present invention; FIG. 4*b* is another exploded view of the plug with connecting device of another preferred embodiment of the present invention; FIG.

Figure 5B:
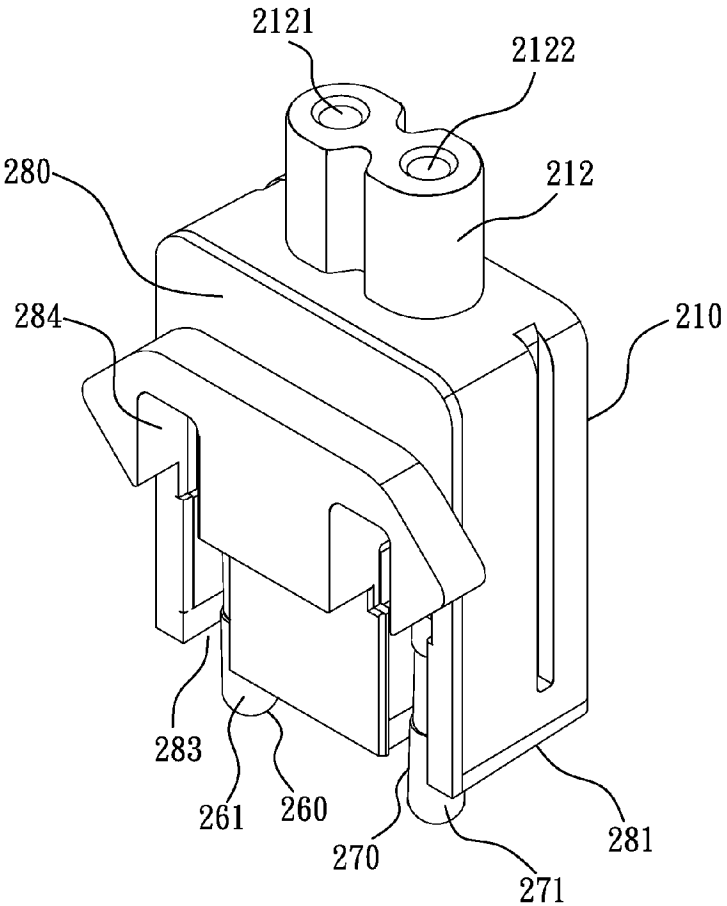
FIG. 5*b* is a schematic view of another preferred embodiment of the present invention illustrating after the plug with connecting device is assembled the electrode columns thereof folding into the bottom plastic housing.
Figure 6B:
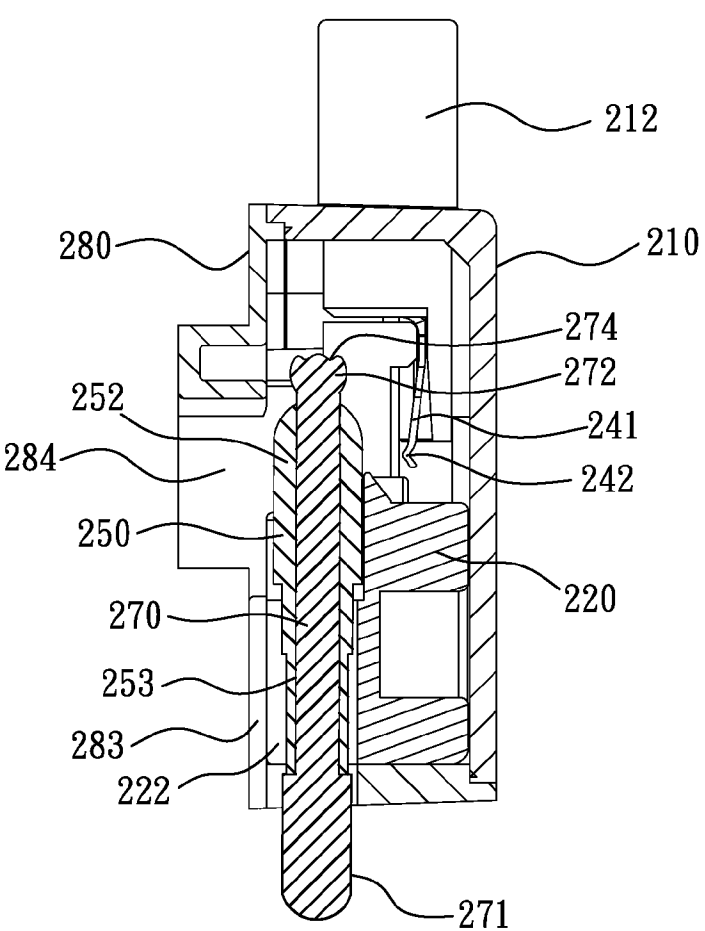
FIG. 6*b* is another schematic cross sectional view of the assembled plug with connecting device of another preferred embodiment of the present invention.
Figure 6A:
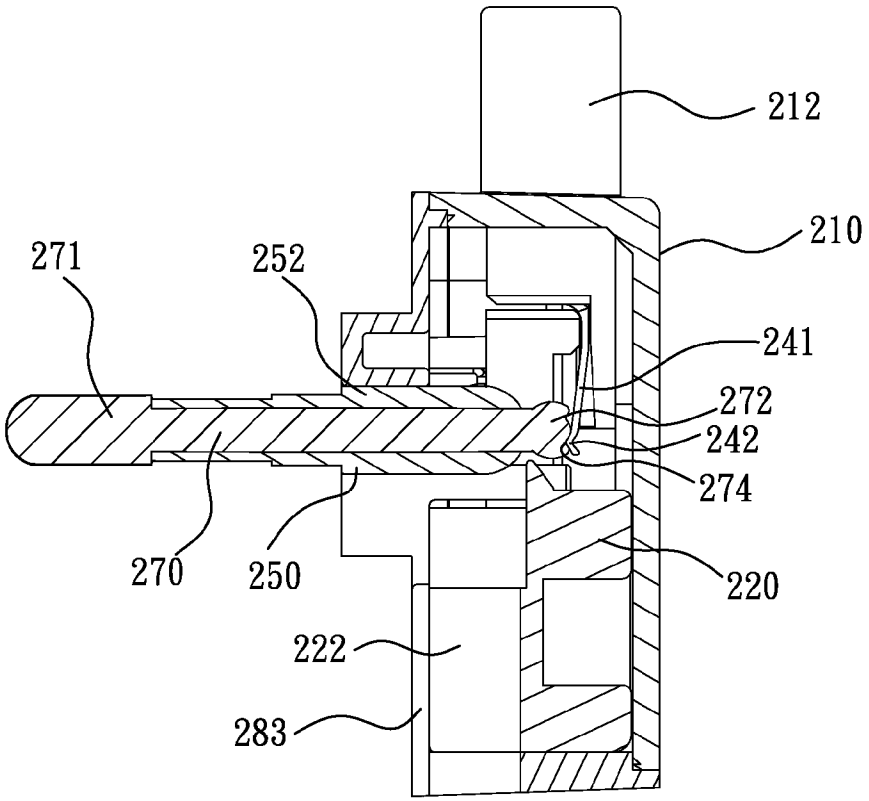
FIG. 6*a* is a schematic cross sectional view of the assembled plug with connecting device of another preferred embodiment of the present invention.

5*a* is a schematic view of another preferred embodiment of the present invention illustrating after the plug with connecting device is assembled the electrode columns thereof extending outside the bottom plastic housing; FIG. 5*b* is a schematic view of another preferred embodiment of the present invention illustrating after the plug with connecting device is assembled the electrode columns thereof folding into the bottom plastic housing; FIG. 6*a* is a schematic cross sectional view of the assembled plug with connecting device of another preferred embodiment of the present invention; FIG. 6*b* is another schematic cross sectional view of the assembled plug with connecting device of another preferred embodiment of the present invention.

As shown in figures, the plug with connecting device of another preferred embodiment of the present invention, includes: a top housing 210, a retaining seat 220, two copper contact rings 230, 240, an electrode column base 250, two electrode columns 260, 270 and a bottom plastic housing 280.

The top housing 210 has a hollow main body 211 and a connecting device 212 is extended from one end of the hollow main body 211 for being connected to a power adapter (not shown), and the connecting device 212 has two ring-shaped slots 2121, 2122, the connecting device 212 is, e.g. but not limited to, a socket with a shape like the numeral 8.

The retaining seat 220 is received in the hollow main body 211 and has a first retaining slot 221 and a column slot 222, wherein the first retaining slot 221 is in a semicircle shape and the column slot 222 is disposed at two ends of the first retaining slot 221, the quantity of the column slot is e.g. two but not serve as a limitation; a bottom end of the retaining seat 220 is further provided with a retaining hole 223 and a top end thereof is provided with a tongue sheet 224.

One end of each of the copper contact rings 230, 240 is in a gradually-expanding shape and is respectively received in the ring-shaped slots 2121, 2122 of the connecting device 212 and the other end thereof is respectively extended with a contact sheet 231, 241, and the contact sheet 231, 241 respectively has a sheet slot 232, 242 provided at the end section of the contact sheet 231, 241.

The electrode column base 250 has a pivotal shaft 251, the shape thereof is, e.g. but not limited to, in a round shape, one lateral side of the pivotal shaft 251 is received in the first retaining slot 221, and two ends of the pivotal shaft 251 respectively has a switch seat 252, the switch seat 252 is received in the first retaining slot 221 for being fastened on the retaining seat 220 and the switch seat 252 further has a seat hole 253.

The two electrode columns 260, 270 are respectively received in the corresponding seat hole 253, one end of each of the electrode columns 260, 270 has a sealing cover 261, 271, the other end thereof is respectively provided with a contact section 262, 272, after passing through the seat hole 253 and exposing outside the switch seat 252; at least one sheet trench 263, 274 are provided on the contact sections 262, 272 for being received in the sheet slots 232, 242; in this embodiment, the contact section 262, 272 are respectively provided with two sheet trenches 263, 274 for illustration and not serving as a limitation.

The bottom plastic housing 280 is able to be engaged with the top housing 210, and has a bottom housing surface 281, the bottom housing surface 281 has two housing slots 283, the bottom end of the housing slot 283 is hollow and an end section of the housing slot 283 has a plane hole 284 with a width larger than the width of the housing slot 283 to receive the switch seat 252 and to allow the electrode columns 260, 270 expose outside, a second retaining slot 285 is provided between the two housing slots 283, the shape thereof is, e.g. but not limited to, in a semicircle shape for fastening the other lateral side of the pivotal shaft 251. The top housing 210 and the bottom plastic housing 280 are made of insulation materials, e.g. but not limited to plastic. The bottom plastic housing 280 further has a slot 286 for being buckled with the tongue sheet 224 so as to fasten the retaining seat 220.

Figure 5A:
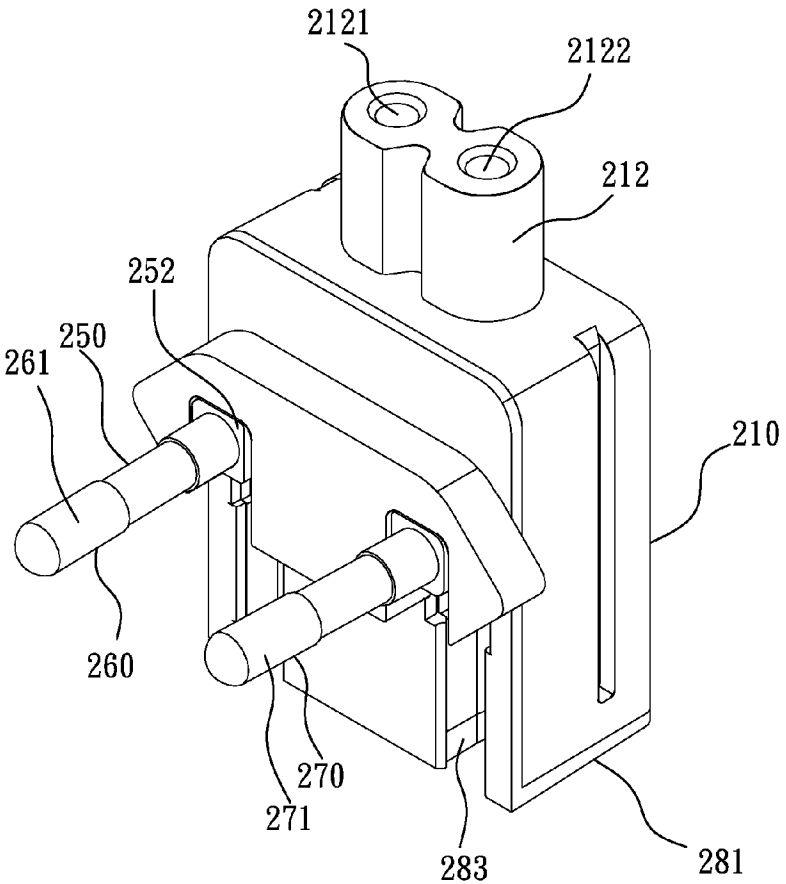
FIG. 5*a* is a schematic view of another preferred embodiment of the present invention illustrating after the plug with connecting device is assembled the electrode columns thereof extending outside the bottom plastic housing.

As shown in FIG. 5*a* and FIG. 6*a*, when assembled, the two copper contact rings 230, 240 are respectively installed in the two ring-shaped slots 2121, 2122, so the contact sheets 231, 241 expose outside the hollow main body 211; the two electrode columns 260, 270 are respectively provided in the corresponding seat hole 253 and exposed outside the switch seat 252 then provided with the contact section 262, 272; the pivotal shaft 251 of the electrode column base 250 is received in the first retaining slot 221 for positioning and fastening; then the other end of the pivotal shaft 251 of the electrode column base 250 is received in the second retaining slot 285 and the tongue sheet 224 is received in the slot 286 for positioning and fastening, so the two electrode columns 260, 270 partially expose outside the housing slots 283; then the top housing 210 is engaged with the bottom plastic housing 280, and the two electrode columns 260, 270 are outwardly pushed so the contact sheets 231, 241 are respectively positioned in the sheet trenches 263, 274 and are in contact with the contact sections 262, 272, then the switch seat 252 is fastened in the column slot 222; the plug with connecting device provided by the present invention is therefore obtained. After the assembly of the plug with connecting device provided by the present invention is assembled, the connecting device 212 is connected to a power adapter (not shown), an AC power source is therefore transferred to the power adapter through the copper contact rings 230, 240.

As shown in FIG. 5*b* and FIG. 6*b*, when folded, the two electrode columns 260, 270 are inwardly pushed into the bottom plastic housing 280 alongside the housing slot 283 and the plane hole 284, and the contact sections 262, 272 are released from the contact sheets 231, 241, and the two electrode columns 260, 270 are aligned with the housing slots 283 to achieve a convenient storage purpose, thus the two electrode columns 260, 270 are not in contact with the ring-shaped slots 2121, 2122 and a power supply terminating status is achieved.

Accordingly, the plug with connecting device provided by the present invention has a grounding sheet to provide a grounding function; and according to actual needs an AC plug is able to be changed for being adopted in various AC power systems.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug with connecting device, comprising:

a top housing having a hollow main body with a connecting device extended from one end of the hollow main body for being connected to a power adapter, and the connecting device having two ring-shaped slots;

a retaining seat received in the hollow main body and having a first retaining slot;

two copper contact rings, wherein one end of each of the copper contact rings is in a gradually expanding shape and respectively installed in the ring-shaped slots of the connecting device, the other end thereof is extended with a contact sheet;

an electrode sheet base, having a pivotal shaft and one lateral side of the pivotal shaft being received in the first retaining slot and two ends of the pivotal shaft being respectively provided with a switch seat, wherein the switch seat further has a seat hole, a positioning slot and a protruding block;

two electrode sheets, respectively received in the seat holes, one end of each of the electrode sheets having a wire hole; and a bottom plastic housing, engaged with the top housing, and having a bottom housing surface, wherein the bottom housing surface has four sheet wings, a housing slot is defined by every two sheet wings and the bottom end of the housing slot is hollow, an end section thereof has a plane hole to allow the electrode sheets being exposed outside, a second retaining slot is provided between the two housing slots for fastening the other lateral side of the pivotal shaft;

when the two electrode sheets are longitudinally rotated, the two electrode sheets are able to be pivotally moved between the housing slots and positioned in the retaining seat;

the other ends of the electrode sheets are in contact with the contact sheets, so an electrical conducting status is formed between the two ring-shaped slots and the two electrode sheets.

2. The plug with connecting device as claimed in claim 1, wherein the top housing and the bottom plastic housing are made of insulation materials.

3. The plug with connecting device as claimed in claim 1, wherein the connecting device is socket with a shape like the numeral 8.

4. The plug with connecting device as claimed in claim 1, wherein the retaining seat further has a positioning hole and a buckling hook.

5. The plug with connecting device as claimed in claim 4, wherein the bottom plastic housing further has a buckling slot, the buckling slot is buckled with the buckling hook for fastening the retaining seat.

6. The plug with connecting device as claimed in claim 1, wherein the protruding block of the electrode sheet base is in an arc shape.

7. The plug with connecting device as claimed in claim 1, wherein the width of the plane hole is larger than that of the housing slot.

8. The plug with connecting device as claimed in claim 1, wherein the contact sheet further as a sheet slot provided at an end section of the contact sheet.

9. The plug with connecting device as claimed in claim 8, wherein the other end of each of the electrode sheets has a sheet trench for receiving the sheet slot.

10. The plug with connecting device as claimed in claim 1, wherein the first retaining slot and the second retaining slot are is in a semicircle shape and the pivotal shaft is in a round shape.

11. A plug with connecting device, comprising:

a top housing having a hollow main body with a connecting device extended from one end of the hollow main body for being connected to a power adapter, and the connecting device having two ring-shaped slots;

a retaining seat received in the hollow main body and having a first retaining slot and a column slot;

two copper contact rings, wherein one end of each of the copper contact rings is in a gradually expanding shape and respectively installed in the ring-shaped slots of the connecting device, the other end thereof is extended with a contact sheet;

an electrode column base having a pivotal shaft and one lateral side of the pivotal shaft being received in the first retaining slot and two ends of the pivotal shaft being respectively provided with a switch seat, wherein the switch seat further has a seat hole; two electrode columns, respectively received in the seat holes, one end of each of the electrode columns has a sealing cover and the other end is provided with a contact section after passing through the hole seat and exposing outside the switch seat; and a bottom plastic housing, engaged with the top housing, and having a bottom housing surface, wherein the bottom housing surface has four sheet wings, a housing slot is defined by every two sheet wings and the bottom end of the housing slot is hollow, an end section thereof has a plane hole to allow the electrode columns expose outside, a second retaining slot is provided between the two housing slots for fastening the other lateral side of the pivotal shaft;

when the two electrode columns are longitudinally rotated, the two electrode columns are able to be pivotally moved between the housing slots and positioned in the column slot; the electrode columns are in contact with the copper contact rings, so an electrical conducting status is formed between the two ring-shaped slots and the two electrode columns.

12. The plug with connecting device as claimed in claim 11, wherein the top housing and the bottom plastic housing are made of plastic materials.

13. The plug with connecting device as claimed in claim 11, wherein the connecting device is socket with a shape like the numeral 8.

14. The plug with connecting device as claimed in claim 11, wherein the retaining seat further has a tongue sheet and a retaining hole.

15. The plug with connecting device as claimed in claim 14, wherein the bottom plastic housing further has a slot, the slot is buckled with the tongue sheet for fastening the retaining seat.

16. The plug with connecting device as claimed in claim 11, wherein the column slot is in an arc shape and the quantity of the column slot is two.

17. The plug with connecting device as claimed in claim 11, wherein the width of the plane hole is larger than that of the housing slot.

18. The plug with connecting device as claimed in claim 11, wherein the first retaining slot and the second retaining slot are is in a semicircle shape and the pivotal shaft is in a round shape.

19. The plug with connecting device as claimed in claim 11, wherein the contact sheet further as a sheet slot provided at an end section of the contact sheet.

20. The plug with connecting device as claimed in claim 19, wherein the contact section has at least one sheet trench for receiving the sheet slot.

* * * * *